US005954204A

United States Patent [19]

Grabowski

[11] Patent Number: 5,954,204

[45] Date of Patent: Sep. 21, 1999

[54] BLISTER PACKAGE

[75] Inventor: Paul P. Grabowski, Portage, Mich.

[73] Assignee: Phatmacia & Upjohn Company, Kalamazoo, Mich.

[21] Appl. No.: 09/043,205

[22] PCT Filed: Sep. 10, 1996

[86] PCT No.: PCT/US96/14138

§ 371 Date: Mar. 12, 1998

§ 102(e) Date: Mar. 12, 1998

[87] PCT Pub. No.: WO97/14630

PCT Pub. Date: Apr. 24, 1997

Related U.S. Application Data

[60] Provisional application No. 60/005,782, Oct. 20, 1995.

[51] Int. Cl.[6] ..... B65D 83/04

[52] U.S. Cl. ..... 206/531; 206/532

[58] Field of Search ..... 206/469, 531, 206/532, 528; 221/89, 302; 222/541.2

[56] References Cited

U.S. PATENT DOCUMENTS

| | | | |
|---|---|---|---|
| D. 237,864 | 12/1975 | Meierhoefer | D9/192 |
| 3,054,503 | 9/1962 | Hartman et al. | 206/42 |
| 3,380,578 | 4/1968 | Sparks | 206/56 |
| 3,503,493 | 3/1970 | Nagy | 206/56 |
| 3,933,245 | 1/1976 | Mullen | 206/498 |
| 4,158,411 | 6/1979 | Hall et al. | 206/531 |
| 4,371,080 | 2/1983 | Haines | 206/531 |
| 4,429,792 | 2/1984 | Machbitz | 206/531 |
| 4,574,954 | 3/1986 | Reid | 206/531 |
| 4,850,489 | 7/1989 | Weithmann et al. | 206/530 |

*Primary Examiner*—David T. Fidei

*Attorney, Agent, or Firm*—Flynn, Thiel, Boutell & Tanis, P.C.

[57] ABSTRACT

A blister package (10) is formed of a rupturable substrate (12), a blister layer (11) formed over the rupturable substrate and a medicament (15) contained between the blister layer and the rupturable substrate. The blister package can be opened an give access to the medicament by deforming the blister layer so that it punctures the rupturable substrate and allows the medicament to be removed thereform, without applying directly a mechanical pressure on the medicament. This allows friable tablets to be protected and minimizes the breakage of all types of tablets during the opening of the blister pack.

17 Claims, 2 Drawing Sheets

BLISTER PACKAGE

This application claims the benefit of U.S. Provisional application Ser. No. 60/005,782, filed Oct. 20, 1995.

BACKGROUND OF THE INVENTION

1. Field of the Invention

The present invention relates in general to article holding and dispensing containers and a method of opening these article holding and dispensing containers and, more particularly, to a medication or tablet holding and dispensing package which permits visual examination of each discrete article or tablet contained therein and a method for opening this package.

2. Description of the Prior Art

Blister-type medication dispensers have achieved great acceptance in the field of pharmaceutical packaging. Various types of blister-type pill dispensers are illustrated in Design Patent No. 237 864 and U.S. Pat. Nos. 3,054,503, 3,380,578, 3,503,493, 3,933,245, 4,158,411, 4,371,080, 4,429,792, 4,574,954 and 4,850,489.

A common method of removing the medication from the prior art blister packages requires the use of a downward pressure applied to an upper surface of the blister thereby forcing the medication against a rupturable substrate which results in the rupturing of the substrate and the egress of the medication from the blister package. This method of removing the medication from the blister package is unsatisfactory when the medicament is highly friable. The forcing of the contact of the medicament with the rupturable substrate may result in the medicament crumbling and the loss of quantities of medication during its removal from the blister pack. Therefore, there is a need to provide a blister pack for frangible medication which can be opened without using the frangible medication as the primary means for rupturing the rupturable substrate making up the blister package and thereby avoiding the crumbling of the friable medication.

SUMMARY OF THE INVENTION

It is a primary object of the present invention to provide a container for receiving and storing individual articles of medication, such as tablets or pills, which allows for the removal of the medication therefrom without using the medication as the principal means in breaking a rupturable substrate of the container.

It is another object of the present invention to provide a method of opening a blister package containing a medication in which the medication is not used as the primary means of rupturing a rupturable substrate making up the blister package.

These and other objects are accomplished by providing a blister package made up of a rupturable substrate, a blister layer formed over the rupturable substrate and a medicament contained between the rupturable substrate and the blister layer. The blister layer is formed from a substantially rigid material and has a first blister contained therein which is sized to completely contain therein the medicament. A second blister is formed in the blister layer and is of annular configuration and surrounds and is joined to the first blister at a depression formed in the blister layer between the first and second blisters. The depression comprises means for engaging with and rupturing the rupturable substrate so that the medicament can be removed from the blister pack.

DESCRIPTION OF THE PREFERRED EMBODIMENTS

Figure 1:
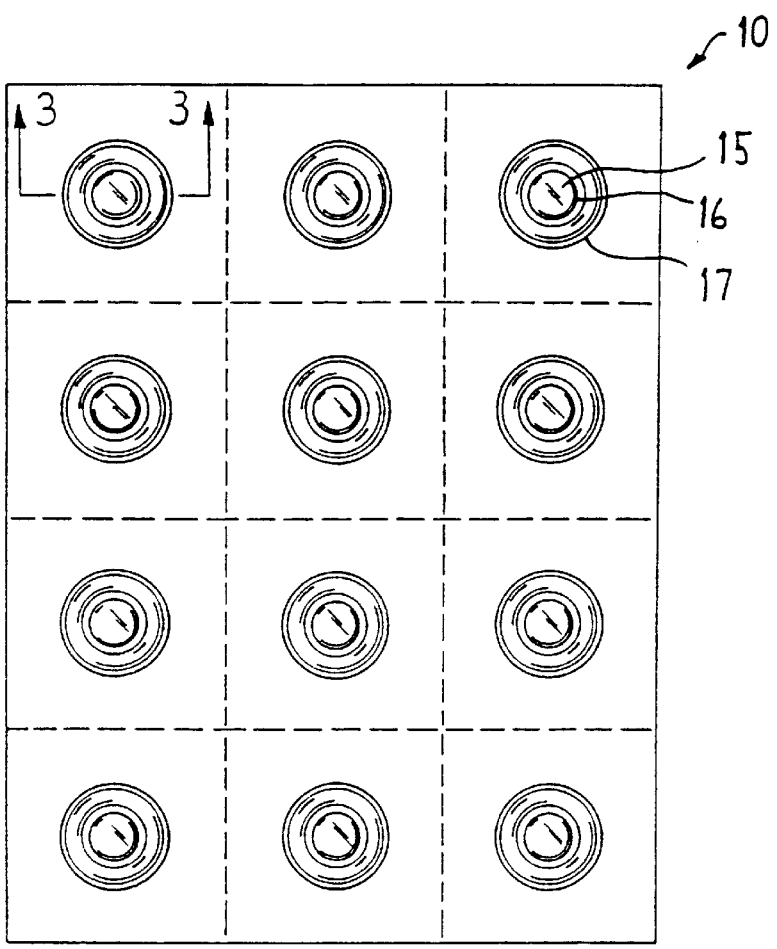
FIG. 1 is a plan view showing a blister pack according to a first embodiment of the present invention.
Figure 3:
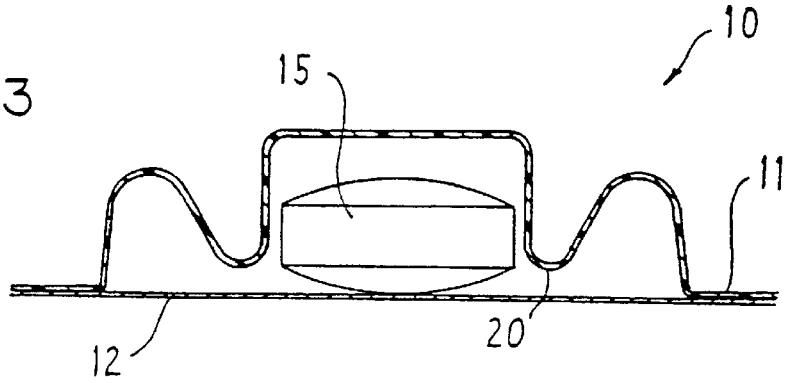
FIG. 3 is a cross-sectional view of the blister package of FIG. 1 taken along lines 3—3 thereof.

Referring now to FIG. 1 of the drawings, a first embodiment of the blister package of the present invention is shown generally at 10. As shown in FIG. 3, the blister pack of the present invention is generally made up of a blister layer 11, a rupturable substrate 12 and a medicament 15 in the form of a tablet or pill contained between the blister layer 11 and the rupturable substrate 12.

Figure 2:
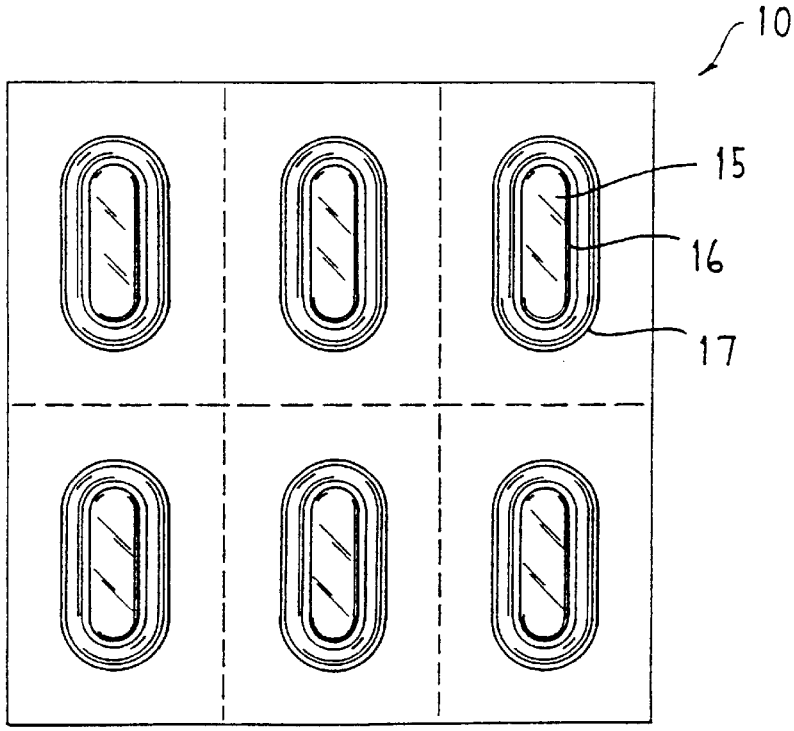
FIG. 2 is a plan view of a blister package according to a second embodiment of the present invention.

The blister layer 11 is preferably made of a thermoplastic material, such as polyvinyl chloride or a polyolefin, and is formed to have a first blister 16 provided therein and a second annular blister 17 surrounding the first blister 16. The first blister 16 is joined to the second annular blister 17 by a depression 20 formed in the blister layer 11. As shown in FIGS. 1 and 2, the first and second blisters can be of circular, oblong or any other type of configuration. The first blister 16 is of a size that it can completely receive and contain therein the medicament 15. The thickness of the blister layer 11 is not critical and is determined according to the size of the medicament 15 contained therein. The blister layer 11 is thinner for smaller size medicaments which are contained in correspondingly smaller first blisters 17 and thicker for larger size medicaments 15 with correspondingly larger size first blisters 17. A suitable size range for the thickness of the blister layer 11 is from 0.005 to 0.015 inch, with 0.01 inch being suitable for most standard applications.

The blister layer 11 is formed over the frangible substrate 12 which may be made of paper, a metal foil or any other suitable material. A metal foil such as aluminum foil is preferred as the rupturable substrate and tempered aluminum foil is particularly preferred. Additionally, the rupturable substrate 12 may be made of a laminate of a paper and a metal foil with the foil upper surface being coated with a film of a thermoplastic material such as polyethylene, polystyrene or the like. The rupturable substrate 12 may be sealed to the blister layer 11 through the application of heat and pressure as is typically done in the art and the blisters 16, 17 may be formed in the blister layer 11 through conventional thermal forming methods. The rupturable substrate 12 may be composed of a plurality of laminated layers of different material as is customary in prior art blister packs as long as its basic operation is not affected.

Figure 4:
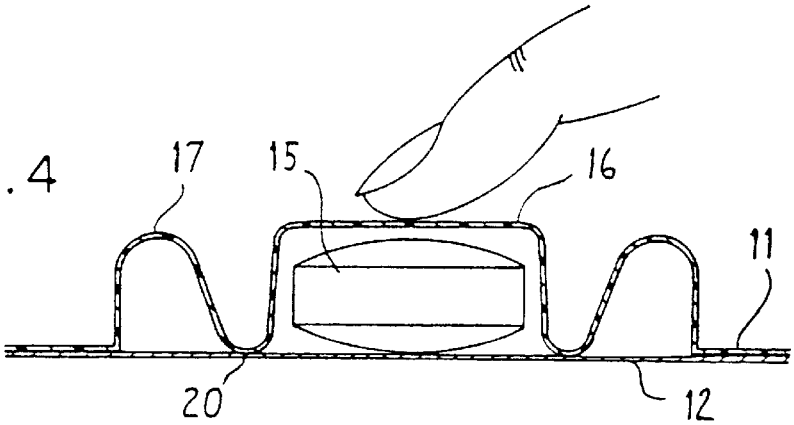
FIG. 4 illustrates the first step in opening the blister package of the present invention.
Figure 5:
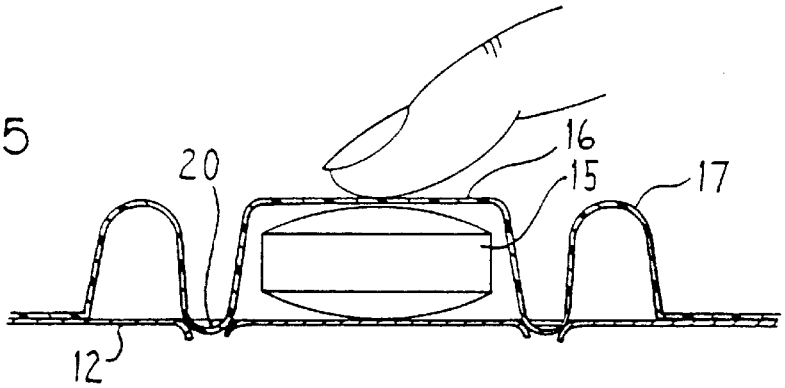
FIG. 5 illustrates the blister layer initially rupturing the rupturable substrate.
Figure 6:
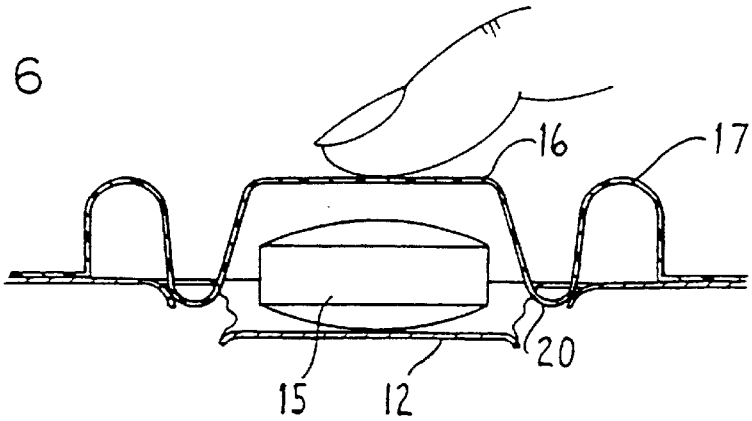
FIG. 6 illustrates the blister layer rupturing the rupturable substrate to an extent that the medication can be removed from the blister.

FIGS. 4–6 illustrate the method of removing a medicament 15 in tablet form from a blister pack 10 of the present invention. As illustrated in FIG. 4, the user applies a downward pressure to an upper surface of the blister layer 11. The downward pressure causes the annular blister 17 to deform and the depression 20 formed between the first blister 16 and the second blister 17 to come into contact with and penetrate the rupturable substrate 12. Since the volume of the first blister 16 is sufficient to contain the medicament 15, the medicament itself is not pressed into contact with the rupturable substrate 12. As illustrated in FIGS. 5 and 6, continued pressure on the upper surface of the first blister 16 causes the depression 20 to completely rupture the rupturable substrate 12 thereby enabling the medicament 15 to be removed from the blister pack 10 without the medicament itself being used to rupture the rupturable substrate 12. As such, the present invention allows the removal of a frangible medicament from a blister pack without the fracturing and crumbling of the medicament.

Although the present invention has been described in specific detail by way of illustration and example for purposes of clarity of understanding, it is understood that certain changes and modifications may be made by one of ordinary skill in the art and still be within the spirit of the invention and scope of the following claims.

The embodiments of the invention in which an exclusive property or privilege is claimed are defined as follows:

1. A blister package comprising a rupturable substrate, a blister layer formed over said rupturable substrate and a medicament contained between said rupturable substrate and said blister layer, said blister layer being formed from a substantially rigid material and having a first blister contained therein, said first blister being sized to completely contain therein said medicament, a second blister formed in said blister layer, said second blister being of annular configuration and being joined to said first blister at a depression formed in said blister layer between said first and second blisters, said depression comprising means for engaging with and rupturing said rupturable substrate so that said medicament can be removed from said blister pack.

2. The blister package of claim 1, wherein said first blister is of oblong configuration.

3. The blister package of claim 1, wherein said first blister is of circular configuration.

4. The blister package of claim 1, wherein said blister layer is formed from polyvinyl chloride.

5. The blister package of claim 1, wherein said blister layer is formed from a thermoplastic material.

6. The blister package of claim 1, wherein said blister layer has a thickness of from about 0.005 to 0.015 inch.

7. The blister package of claim 6, wherein said blister layer has a thickness of about 0.01 inch.

8. The blister package of claim 1, wherein said rupturable substrate is formed from a tempered metal foil.

9. A method of removing a medicament from a blister package, said blister package comprising a rupturable substrate, a blister layer formed over said rupturable substrate and a medicament contained between said rupturable substrate and said blister layer, said blister layer having a first blister contained therein, said first blister being sized to completely contain therein said medicament, a second blister formed in said blister layer, said second blister being of annular configuration and being joined to said first blister at a depression formed in said blister layer between said first and second blisters, said method comprising the steps of:

applying pressure to a top surface of said first blister;

deforming said second annular blister such that said depression is brought into engagement with said rupturable substrate;

rupturing said rupturable substrate with said depression to provide an opening in said rupturable substrate; and removing said medicament from the blister package through said opening provided in said rupturable substrate.

10. The method of claim 9, wherein said first blister is of oblong configuration.

11. The method of claim 9, wherein said first blister is of circular configuration.

12. The method of claim 9, wherein said blister layer is formed from a thermoplastic material.

13. The method of claim 9, wherein said blister layer is formed from a polyolefin.

14. The method of claim 9, wherein said blister layer is formed from polyvinyl chloride.

15. The method of claim 9, wherein said blister layer has a thickness of from about 0.005 to 0.015 inch.

16. The method of claim 15, wherein said blister layer has a thickness of about 0.01 inch.

17. The method of claim 9, wherein said rupturable substrate is formed from a tempered metal foil.

* * * * *

UNITED STATES PATENT AND TRADEMARK OFFICE

CERTIFICATE OF CORRECTION

PATENT NO : 5 954 204
DATED : September 21, 1999
INVENTOR(S) : Paul P. GRABOWSKI

It is certified that error appears in the above-identified patent and that said Letters Patent are hereby corrected as shown below:

On the title page:
[73] Assignee: change "Phatmacia & Upjohn Company" to ---Pharmacia & Upjohn Company---.

Signed and Sealed this

First Day of May, 2001

*Attest:*

Nicholas P. Godici

NICHOLAS P. GODICI

*Attesting Officer*

*Acting Director of the United States Patent and Trademark Office*